US009334457B2

(12) United States Patent
Sakai et al.

(10) Patent No.: US 9,334,457 B2
(45) **Date of Patent: *May 10, 2016**

(54) ASH-FREE COAL PRODUCTION METHOD

(71) Applicant: Kabushiki Kaisha Kobe Seiko Sho (Kobe Steel, Ltd.), Hyogo (JP)

(72) Inventors: Koji Sakai, Hyogo (JP); Noriyuki Okuyama, Hyogo (JP); Shigeru Kinoshita, Hyogo (JP); Takuya Yoshida, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/358,888

(22) PCT Filed: Dec. 14, 2012

(86) PCT No.: PCT/JP2012/082452

§ 371 (c)(1),
(2) Date: May 16, 2014

(87) PCT Pub. No.: WO2013/099650

PCT Pub. Date: Jul. 4, 2013

(65) Prior Publication Data

US 2014/0305034 A1 Oct. 16, 2014

(30) Foreign Application Priority Data

Dec. 28, 2011 (JP) ..... 2011-288713
Dec. 28, 2011 (JP) ..... 2011-288714

(51) Int. Cl.
*C10L 5/04* (2006.01)
*C10L 9/00* (2006.01)

(52) U.S. Cl.
CPC ... *C10L 5/04* (2013.01); *C10L 9/00* (2013.01); *C10L 2290/06* (2013.01); *C10L 2290/08* (2013.01); *C10L 2290/24* (2013.01); *C10L 2290/48* (2013.01); *C10L 2290/544* (2013.01)

(58) Field of Classification Search
CPC ..... C10L 5/04; C10L 9/00
USPC ..... 44/620, 627
See application file for complete search history.

(56) References Cited

U.S. PATENT DOCUMENTS 4,374,015 A * 2/1983 Brule ..... C10G 1/002 208/415
7,799,100 B2 * 9/2010 Harada et al. ..... 44/282

(Continued)

FOREIGN PATENT DOCUMENTS

JP S53-24301 A 3/1978
JP S56-145974 A 11/1981

(Continued)

OTHER PUBLICATIONS

International Search Report; PCT/JP2012/082452; Mar. 5, 2013.

(Continued)

*Primary Examiner* — Ellen McAvoy
(74) *Attorney, Agent, or Firm* — Studebaker & Brackett PC

(57) ABSTRACT

Provided is an ash-free coal production method that can produce an ash-free coal efficiently with a higher solvent recovery rate. The ash-free coal production method includes an extraction step of mixing coal with a solvent to give a slurry and heating the slurry to extract a solvent-soluble coal component; a separation step of separating a solution containing the coal component from the slurry containing the extracted coal component; and an ash-free coal obtaining step of separating and recovering the solvent from the separated solution to give an ash-free coal. The ash-free coal obtaining step includes a pressure-reducing substep of reducing a pressure to a level lower than the solvent vapor pressure to evaporatively separate the solvent from the solution to thereby give a solid ash-free coal; and a heating substep of heating the solid ash-free coal to evaporatively separate a residual solvent from the ash-free coal.

4 Claims, 2 Drawing Sheets

(56) References Cited

U.S. PATENT DOCUMENTS

| | | | | |
|---|---|---|---|---|
| 8,226,816 | B2 * | 7/2012 | Kennel et al. | 208/39 |
| 2006/0278041 | A1 | 12/2006 | Harada et al. | |
| 2010/0006477 | A1 * | 1/2010 | Okuyama et al. | 208/428 |

FOREIGN PATENT DOCUMENTS

| | | | |
|---|---|---|---|
| JP | 2005-120185 | A | 5/2005 |
| JP | 2007-023190 | A | 2/2007 |

OTHER PUBLICATIONS

Written Opinion of the International Searching Authority; PCT/JP2012/082452; Mar. 5, 2013.

Fan Li-hua et al.; "Research Progress on Ash-Free Coal Preparation and Application"; Coal Science and Technology; Mar. 2011; pp. 120-124; vol. 39; No. 3; China.

* cited by examiner

ASH-FREE COAL PRODUCTION METHOD

TECHNICAL FIELD

The present invention relates to a method for producing an ash-free coal by removing ash from coal.

BACKGROUND ART

An exemplary ash-free coal production method is one described in Patent Literature (PTL) 1. The ash-free coal production method produces an ash-free coal by mixing coal with a solvent to prepare a slurry; heating the slurry to extract a coal component soluble in the solvent (hereinafter also referred to as a "solvent-soluble component"); separating the slurry containing the extracted solvent-soluble component into a solution and a solids-enriched fluid, where the solution contains the solvent-soluble component, and the solids-enriched fluid contains a coal component insoluble in the solvent (hereinafter also referred to as a "solvent-insoluble component"); and separating and recovering the solvent from the separated solution to give the ash-free coal. The solvent separated and recovered from the solution is stored in a solvent tank and reused. The ash-free coal production method employs spray drying to separate and recover the solvent from the solution to thereby give the ash-free coal. The spray drying allows an organic substance and an inorganic substance in the ash-free coal to precipitate separately and enables easy removal of a fine inorganic substance and a metal component, where the inorganic substance is mixed in a small amount in the solution containing the solvent-soluble component, and the metal component is dissolved in the solvent.

CITATION LIST

Patent Literature

PTL 1; Japanese Unexamined Patent Application Publication (JP-A) No. 2005-120185

SUMMARY OF INVENTION

Technical Problem

However, the spray drying, when employed to separate and recover the solvent, may fail to sufficiently separate and recover the solvent from the solution typically when the solution contains the solvent in a high content (in weight percent) because a large amount of the solvent is to be evaporated. This increases the ash-free coal production cost because another portion of the solvent should be fed to the ash-free coal production equipment in an amount corresponding to the amount of the residual solvent in the ash-free coal without separation and recovery.

A possible solution to provide a higher solvent recovery rate is a process that includes two or more steps for separating and recovering the solvent to recover the solvent in multiple times (in multiple stages). A possible exemplary process is the process of separating and recovering the solvent simply by spray drying to give an ash-free coal, and separating and recovering a residual solvent from the ash-free coal by spray drying again. The ash-free coal obtained by spray drying, however, is a powdery or granular solid and disadvantageously exhibits poor handleability upon transfer to a subsequent separator (downstream step). The ash-free coal obtained by separating and recovering the solvent therefrom by spray drying, upon another separation of the solvent by spray drying, should therefore be once re-liquefied before being fed to the separator. This causes the ash-free coal to have inferior production efficiency and higher production cost.

The handleability of ash-free coal will be described below. As used herein the term "handleability" refers to ease of ash-free coal handling. The ash-free coal, when handleable as a liquid (handleable in liquid form) can be easily handled.

An ash-free coal is generally solid at room temperature, has increasing fluidity and becomes handleable as a liquid with an elevating temperature. The customary ash-free coal production method (e.g., spray drying in PTL 1) gives an ash-free coal which contains the residual solvent in a content of typically from 0 to 2 percent by weight and which has a high initial softening temperature at which the solid ash-free coal starts melting. The ash-free coal exhibits poor handleability because it is incapable of handling as a liquid unless it is heated to a considerably high temperature (380° C.). The ash-free coal obtained by spray drying has to be transferred to a downstream separator in solid form with poor handleability.

The present invention has been made under such circumstances, and an object thereof is to provide an ash-free coal production method that can recover the solvent with a higher recovery rate and can produce an ash-free coal efficiently.

Solution to Problem

To achieve the object, the present invention provides a method for producing an ash-free coal, the method including the steps of extracting a solvent-soluble coal component from coal by mixing the coal with a solvent to give a slurry and heating the slurry; separating a solution containing the coal component from the slurry, the slurry containing the extracted coal component extracted in the extraction step; and obtaining an ash-free coal by separating and recovering the solvent from the solution separated in the separation step. In the method, the ash-free coal obtaining step includes the substeps of reducing a pressure to a level lower than a vapor pressure of the solvent to evaporatively separate the solvent from the solution to thereby give a solid ash-free coal; and heating the solid ash-free coal obtained from the pressure-reducing substep to evaporatively separate a residual solvent from the ash-free coal.

The present invention further provides, to achieve the object, a method for producing an ash-free coal, the method including the steps of extracting a solvent-soluble coal component from coal by mixing the coal with a solvent to give a slurry and heating the slurry; separating a solution containing the coal component from the slurry, the slurry containing the extracted coal component extracted in the extraction step; and obtaining an ash-free coal by separating and recovering the solvent from the solution separated in the separation step. In the method, the ash-free coal obtaining step includes a first evaporation substep of evaporatively separating the solvent from the solution to give an ash-free coal; and a second evaporation substep of evaporatively separating a residual solvent from the ash-free coal, the ash-free coal obtained from the first evaporation substep by evaporative separation of the solvent; the first evaporation substep is performed so as to allow the solvent to remain in the ash-free coal and to allow the ash-free coal to be in liquid form; and the liquid ash-free coal is transferred in liquid form to the second evaporation substep.

Advantageous Effects of Invention

The present invention can recover the solvent with a higher recovery rate and can produce an ash-free coal efficiently.

DESCRIPTION OF EMBODIMENTS

Some embodiments of the present invention will be illustrated with reference to the attached drawings.

First Embodiment

Structure of Ash-Free Coal Production Equipment 1

Figure 1:
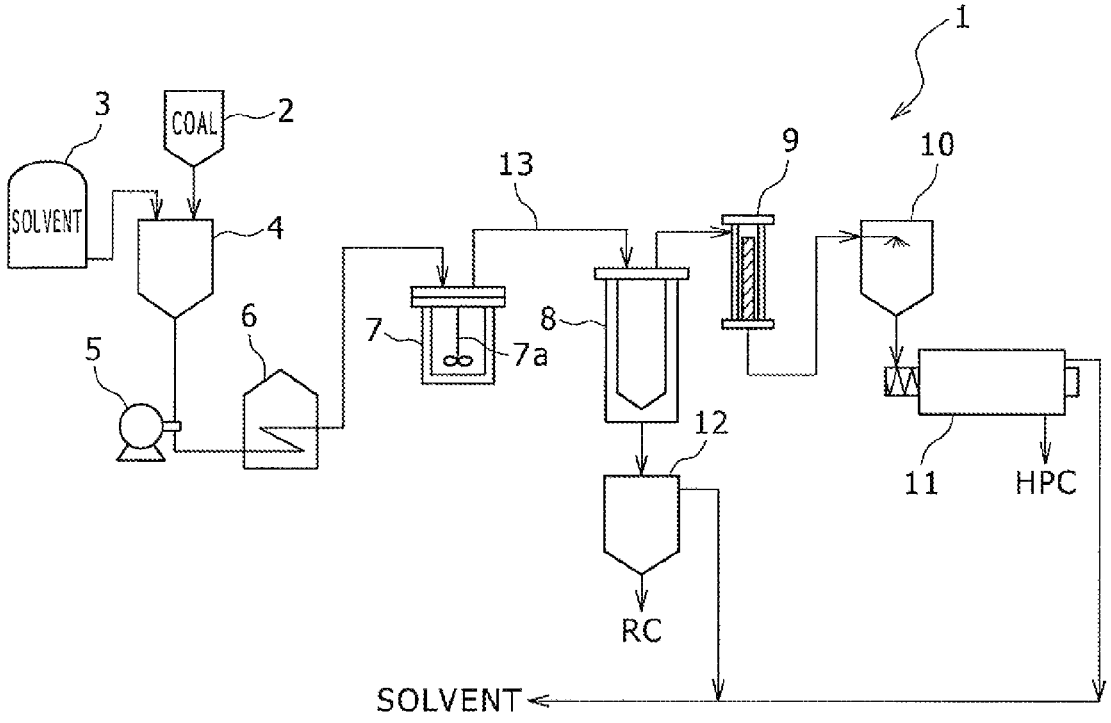
FIG. 1 is a schematic diagram illustrating ash-free coal production equipment for use in a first embodiment of the present invention.

FIG. 1 is a schematic diagram illustrating ash-free coal production equipment 1 for use in the first embodiment of the present invention. With reference to FIG. 1, the ash-free coal production equipment 1 for use in the present embodiment includes a coal hopper 2 that stores and cuts coal; a solvent tank 3 that stores a solvent; a slurry preparation tank 4 that prepares a slurry by mixing the coal with the solvent; a pump 5 that transfers the prepared slurry; a preheater 6 that heats the transferred slurry; an extractor 7 that extracts a solvent-soluble component from the transferred slurry; a gravitational settling tank 8 that separates the slurry containing the extracted solvent-soluble component into a solution (supernatant liquid) containing the solvent-soluble component and a solids-enriched fluid containing a solvent-insoluble component, where the separation is performed by the gravitational settling technique; a filter unit 9 that filtrates the solution; a flasher 10 and a steam tube dryer 11 that separate and recover the solvent from the filtrated solution to give an ash-free coal (hyper coal; HPC); and a solvent separator 12 that separates the solvent from the solids-enriched fluid obtained from the gravitational settling tank 8, to give a residue coal (RC).

Next, an ash-free coal production method according to the present embodiment will be illustrated. The ash-free coal production method according to the present embodiment includes an extraction step, a separation step, and an ash-free coal obtaining step. The individual steps will be described below. The material coal is not limited and may be bituminous coal having a high extraction rate (ash-free coal recovery rate) or a more-inexpensive low-quality coal (e.g., subbituminous coal or lignite).

Extraction Step

The extraction step is the step of mixing coal with a solvent to give a slurry and heating the slurry to extract a solvent-soluble component from the coal. The extraction step in the present embodiment includes a slurry preparation substep of preparing a slurry by mixing the coal with the solvent; and a solvent-soluble component extraction substep of extracting the solvent-soluble component from the coal by heating the slurry obtained from the slurry preparation substep.

As used herein the term "solvent-soluble component" refers to a coal component that is soluble in the solvent by extraction of the coal with the solvent and is derived from an organic component in the coal, where the component has a relatively low molecular weight with an undeveloped crosslinked structure.

When coal is mixed with a solvent to give a slurry and the slurry is heated to extract a solvent-soluble component from the coal, the coal may be mixed with a solvent having a large dissolving power (solvency) with respect to the coal to give a slurry, and the slurry is heated to extract an organic component from the coal. The solvent herein is often an aromatic solvent (a hydrogen-donor or a non-hydrogen-donor solvent).

The non-hydrogen-donor solvent is a coal derivative that is purified mainly from a carbonization product of the coal, mainly contains bicyclic aromatic compounds, and serves as a solvent. The non-hydrogen-donor solvent is stable even under heating and has satisfactory affinity for the coal. The non-hydrogen-donor solvent thereby has a high rate of a soluble component (hereinafter also referred to as a "coal component") to be extracted with the solvent, and acts as a solvent easily recoverable by a procedure such as distillation. The rate of the coal component to be extracted is hereinafter also referred to as "extraction rate". The non-hydrogen-donor solvent contains, as exemplary principal components, bicyclic aromatic components such as naphthalene, methylnaphthalene, dimethylnaphthalene, and trimethylnaphthalene. The non-hydrogen-donor solvent may further contain other components including naphthalenes, anthracenes, and fluorenes each having an aliphatic side chain; and alkylbenzenes corresponding to them, except with biphenyl and/or a long-chain aliphatic side chain.

The above description has been made by taking a non-hydrogen-donor compound as an example of the solvent to be used. Certainly, a hydrogen-donor compound (including a coal-derived liquid) typified by tetralin can also be used as the solvent. The hydrogen-donor solvent, when used, contributes to a higher yield of the ash-free coal.

Though not critical, the solvent has a boiling point of typically preferably from 180° C. to 300° C., and particularly preferably from 240° C. to 280° C. The boiling point range is preferred from the viewpoints of reducing the pressure in the extraction step and the separation step and of providing a satisfactory extraction rate in the extraction step and a satisfactory solvent recovery rate in the ash-free coal obtaining step.

Slurry Preparation Substep

The slurry preparation substep is the step of mixing the coal with the solvent to give a slurry and is performed in the slurry preparation tank 4 illustrated in FIG. 1. The coal and the solvent are charged from the coal hopper 2 and the solvent tank 3, respectively, into the slurry preparation tank 4. The coal and the solvent charged into the slurry preparation tank 4 are mixed with each other by a stirrer (not shown) and form a slurry.

Though not critical, the blending ratio of the coal to the solvent is typically preferably from 10 to 50 percent by weight and more preferably from 15 to 35 percent by weight, on a dry coal basis.

Solvent-soluble Component Extraction Substep

The solvent-soluble component extraction substep is performed in the preheater 6 and the extractor 7 in FIG. 1. The slurry prepared in the slurry preparation tank 4 is once fed to the preheater 6 by the pump 5, heated therein to a predetermined temperature, then fed to the extractor 7, and kept to a predetermined temperature while being stirred with a stirrer 7*a* to perform extraction. The preheater 6 does not have to be arranged.

The slurry temperature in the solvent-soluble component extraction substep is not critical, as long as the solvent-soluble component can be dissolved, but is typically from 300° C. to 420° C., and more preferably from 350° C. to 400° C. The range is preferred for sufficient extraction of the solvent-soluble component.

The heating time (extraction time) is also not critical, but is preferably from 5 to 60 minutes, and more preferably from 20 to 40 minutes. The range is preferred for sufficient dissolution and a high extraction rate. When the slurry is once heated in the preheater 6, the term "heating time" refers to a total sum of the heating time in the preheater 6 and that in the extractor 7.

In a preferred embodiment, the solvent-soluble component extraction substep is performed in the presence of an inert gas such as nitrogen gas. The pressure in the extraction step is preferably from 1.0 to 2.0 MPa, though it may vary depending on the extraction temperature and the vapor pressure of the solvent to be used. If the inside pressure of the extractor 7 is lower than the solvent vapor pressure, the solvent fails to be trapped in a liquid phase because of its volatilization, and this impedes extraction. Trapping of the solvent in the liquid phase requires a pressure higher than the solvent vapor pressure. In contrast, an excessively high inside pressure may cause higher equipment cost and operation cost, thus being uneconomical.

In the present embodiment, the coal and the solvent are mixed with each other to give a slurry, and the slurry is heated to extract a solvent-soluble coal component from the coal. In another embodiment, the solvent alone is formerly heated, the coal is fed as intact (as dried) into the heated high-temperature solvent (e.g., at 380° C.) and thereby mixed with the solvent and heated to extract a solvent-soluble component from the coal with the solvent.

A way to heat the solvent alone formerly and to feed the coal as intact (as dried) into the heated high-temperature solvent (e.g., at 380° C.) is exemplified in an embodiment as follows. The coal hopper 2 is arranged not upstream from the pump 5, but typically as a lock hopper in a pipe 13 or in the extractor 7 so as to directly feed the coal into the extractor 7. The pipe 13 connects between the preheater 6 and the extractor 7. In this embodiment, the solvent and other components are prevented from running back into the coal hopper 2 typically by pressurizing the joint between the coal hopper 2 and the pipe 13 or the extractor 7 with an inert gas such as nitrogen gas. The method (equipment) according to the embodiment can omit the slurry preparation tank 4, although it requires pressurization of the joint between the coal hopper 2 and the pipe 13 or the extractor 7 with an inert gas such as nitrogen gas so as to prevent the solvent and other components from running back into the coal hopper 2.

In another embodiment, the method does not employ the extractor 7. Typically, a pipe is arranged to directly connect between the preheater 6 and the gravitational settling tank 8; and the coal hopper 2 (e.g., lock hopper) is arranged so as to feed the coal directly into the pipe. In this embodiment, the solvent and other components are prevented from running back into the coal hopper 2 typically by pressurizing the joint between the pipe and the coal hopper 2 with an inert gas such as nitrogen gas. The method (equipment) according to the embodiment can omit not only the slurry preparation tank 4, but also the extractor 7, although it requires pressurization of the joint between the pipe and the coal hopper 2 with an inert gas such as nitrogen gas so as to prevent the solvent and other components from running back into the coal hopper 2.

Separation Step

The separation step is the step of separating the slurry into a solution (supernatant liquid) containing the solvent-soluble component and a solids-enriched fluid containing a solvent-insoluble component and is performed in the gravitational settling tank 8 in FIG. 1, where the slurry contains the extracted solvent-soluble component extracted in the extraction step. The separation herein is performed by the gravitational settling technique. The gravitational settling technique is a separation technique of settling solids using the gravity to separate the solids from a liquid. The technique enables continuous separation treatment because the solution containing the solvent-soluble component and the solids-enriched fluid containing the solvent-insoluble component can be discharged from the upper part and the lower part, respectively, of the settling tank while continuously feeding the slurry into the tank.

The solution containing the solvent-soluble component accumulates in the upper part of the gravitational settling tank 8 and is discharged, where necessary via filtration in the filter unit 9, to the flasher. In contrast, the solids-enriched fluid containing the solvent-insoluble component accumulates in the lower part of the gravitational settling tank 8 and is discharged to the solvent separator 12. The separation technique is not limited to the gravitational settling technique and is also exemplified by filtration or centrifugal separation. In this case, a filter or centrifugal separator is used as a solid-liquid separator instead of the gravitational settling tank.

As used herein the term "solvent-insoluble component" refers to a coal component (solid matter) which remains without being dissolved in a solvent even after coal component extraction with the solvent and which is exemplified by ash and a coal containing the ash (namely residue coal). The solvent-insoluble component is derived from an organic component having a relatively high molecular weight with a developed crosslinked structure.

The inside of the gravitational settling tank 8 is preferably held in temperature or heated, and/or pressurized so as to prevent reprecipitation of the solvent-soluble component. The heating temperature is preferably from 300° C. to 420° C., and the pressure is preferably from 1.0 to 3.0 MPa and more preferably from 1.7 to 2.3 MPa. The time for the slurry to be held in the gravitational settling tank 8 is not critical, but may be from about 30 to 120 minutes to perform separation by precipitation (settling).

Ash-free Coal Obtaining Step

The ash-free coal obtaining step is the step of separating and recovering the solvent from the solution (supernatant liquid) separated in the separation step to give an ash-free coal. The ash-free coal obtaining step in the present embodiment includes a pressure-reducing substep and a heating substep. The pressure-reducing substep is the step of reducing the pressure of the system to a level lower than the vapor pressure of the solvent to evaporatively separate the solvent from the solution to thereby yield a solid (powdery or granular) ash-free coal. The heating substep is the step of heating the ash-free coal obtained from the pressure-reducing substep to evaporatively separate or remove the residual solvent in the ash-free coal again.

Pressure-Reducing Substep

The pressure-reducing substep is the step of evaporatively separating the solvent from the solution by flash vaporization and is performed in the flasher 10 in FIG. 1, where the solution is separated and obtained from the separation step. The flash vaporization refers to a distillation technique of spraying (flashing) a distillation object into the flasher so as to evaporatively separate a substance having a low boiling point from the object. In the present embodiment, the distillation object is the solution separated in the separation step, and the substance having a low boiling point is the solvent. The object may be sprayed typically to the inner wall of the flasher.

The present embodiment performs evaporative separation of the solvent from the solution fed into the flasher 10 by reducing the inside pressure of the flasher 10 to a level lower than the solvent vapor pressure. The solvent vapor pressure is typically 1.0 MPa at a solvent temperature of 380° C.; and in this case, the inside pressure is reduced typically to 0.1 MPa. The separated solvent is recovered, recycled to, and reused in the slurry preparation tank 4. The pressure-reducing substep is preferably performed in the presence of an inert gas such as nitrogen gas for satisfactory solvent recovery.

The solution prior to feeding into the flasher 10 may be pressurized to a pressure higher than the solvent vapor pressure and is in liquid form. The pressure is typically 2.0 MPa at 380° C. The solution prior to feeding into the flasher 10 may have a temperature of typically 300° C.

The pressure-reducing substep gives a solid (powdery or granular) ash-free coal. This is because the inside pressure of the flasher 10 is lower than the solvent vapor pressure; the solvent evaporates to remove sensible heat from the ash-free coal; and thereby the ash-free coal temperature falls to a level (e.g., from about 150° C. to about 230° C.) lower than the temperature at which the ash-free coal exhibits fluidity. Particularly, the inside pressure of the flasher 10 in the present embodiment is lowered to a level approximately equal to or lower than atmospheric pressure. This allows the ash-free coal to be solid and to contain the residual solvent in a smaller content. The resulting ash-free coal is prevented from fusing or precipitating onto a heat source (a tube 23 of the steam tube dryer 11 herein) in the heating substep and from causing inferior heat exchange efficiency and a lower solvent recovery rate. The inside pressure of the flasher 10 may be higher than atmospheric pressure, as long as the ash-free coal can be obtained in solid form and the pressure is lower than the solvent vapor pressure. The inside temperature of the flasher 10 may be adapted to be from about 10° C. to about 230° C. so as to prevent the ash-free coal from fusing or precipitating onto the inside of the flasher 10.

Specifically, the solid ash-free coal obtained from the pressure-reducing substep is a powder or granule having a particle size (maximum dimension) of about several millimeters or less, typically from about several micrometers to about several hundreds of micrometers.

The content of residual solvent in the ash-free coal obtained from the pressure-reducing substep is not critical, as long as the ash-free coal be solid, but is preferably 10 percent by weight or less. This is preferred for preventing the ash-free coal from fusing or precipitating onto the heat source in the heating substep. As used herein the term "content of residual solvent in the ash-free coal" refers to the content (percentage) of the residual solvent in the ash-free coal based on the total amount of the mixture of the ash-free coal and the residual solvent in the ash-free coal.

An exemplary way to reduce the content of residual solvent in the ash-free coal to 10 percent by weight or less is a process of reducing the inside pressure of the flasher 10 to a level approximately equal to or lower than atmospheric pressure. In a preferred embodiment, the evaporative separation in this process is performed for a time approximately equal to the time necessary to separate approximately 100 percent by weight (99 percent by weight or more) of the solvent, as in the customary techniques.

The solvent, if remaining in the ash-free coal, causes the ash-free coal to have a lower softening temperature. Accordingly, the lowering of softening temperature can be suppressed by reducing the content of residual solvent in the ash-free coal obtained from the pressure-reducing substep. This can give an ash-free coal which exhibits little plastic property even upon heating (e.g., about 200° C. to 230° C.) and which less fuses or precipitates onto the heat source in the heating substep.

The present embodiment employs flash vaporization to evaporatively separate the solvent in the pressure-reducing substep. The evaporative separation, however, may be performed by any other technique such as vacuum distillation, as long as the solvent can be evaporatively separated by pressure reduction.

Heating Substep

The heating substep is the step of evaporatively separating the residual solvent from the ash-free coal by distillation using a steam tube dryer and is performed in the steam tube dryer 11 in FIG. 1. The ash-free coal herein is obtained from the pressure-reducing substep and contains a residual solvent. The distillation using the steam tube dryer is the technique of indirectly heating a solid distillation object in a dryer to evaporatively separate a substance having a low boiling point from the distillation object. In the present embodiment, the solid distillation object is the solid ash-free coal obtained from the pressure-reducing substep; and the substance having a low boiling point is the solvent.

Figure 2:
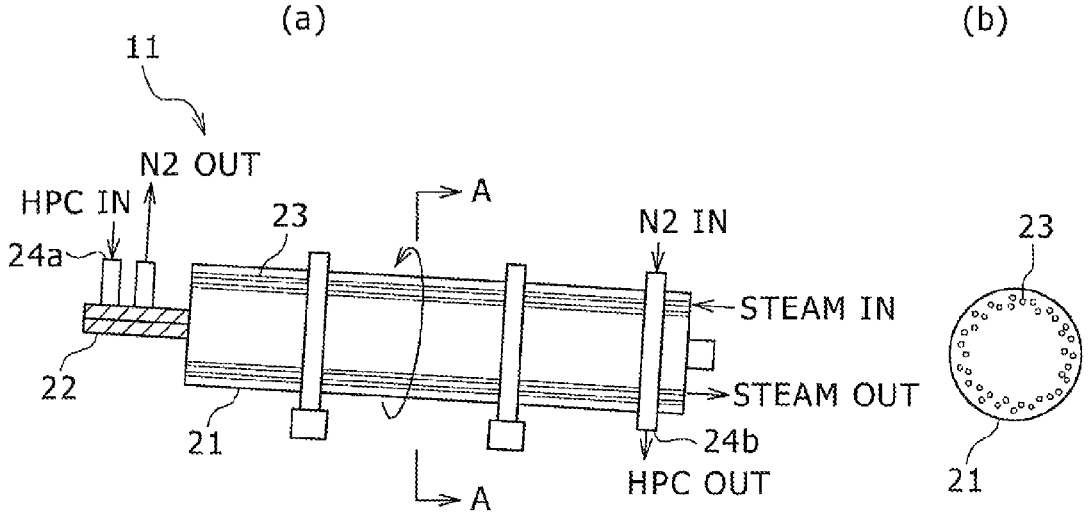
FIGS. 2(*a*) and 2(*b*) are a front view and a cross-sectional view along line A-A in FIG. 2(*a*), respectively, schematically illustrating a steam tube dryer for use in the ash-free coal production equipment illustrated in FIG. 1.

The distillation using the steam tube dryer 11 will be illustrated in detail below with reference to FIGS. 2(*a*) and 2(*b*). FIGS. 2(*a*) and 2(*b*) are a front view and a cross-sectional view along the line A-A in FIG. 2(*a*), respectively, schematically illustrating the steam tube dryer 11.

The solid ash-free coal obtained from the pressure-reducing substep is charged into a dryer body 21 by a screw conveyor 22. The charging may be performed by another device or process than the screw conveyor 22. The ash-free coal charged into the dryer body 21 is stirred by the rotation of the dryer body 21 and is indirectly heated by contact with the two or more tubes 23 through which steam at a high temperature (e.g., 215° C. or 225° C.) passes. A plurality of the tubes 23 is arranged in an outer peripheral portion in the dryer body 21 as illustrated in FIG. 2(*b*). The residual solvent in the ash-free coal is evaporatively separated by the contact with the tubes 23. This gives an ash-free coal from which approximately 100 percent by weight of the solvent has been removed. The separated solvent is recovered with an inert gas (e.g., nitrogen) flowing in the dryer body 21 and recycled to and reused in the slurry preparation tank 4. The dryer body 21 is arranged in an inclined position toward the outlet 24*b* so as to allow the ash-free coal fed from a supply port 24*a* to be discharged from the outlet 24*b*.

The embodiment employing the distillation using the steam tube dryer 11 allows the solid ash-free coal obtained from the pressure-reducing substep to be charged as in solid form into the dryer body 21. In addition, the embodiment employs heating to evaporatively separate the solvent and can perform evaporative separation in a shorter time.

The present embodiment employs the distillation using the steam tube dryer 11 in the heating substep. Distillation, however, can be performed by any other technique, as long as the solid ash-free coal can be charged and the solvent is evaporatively separated by heating.

The pressure-reducing substep and the heating substep can yield an ash-free coal from the solution, where the ash-free coal contains substantially no ash, from which approximately 100% of the solvent has been removed. The ash-free coal, finally obtained after heating in the heating substep to evaporatively separate or remove the solvent therefrom, has a residual solvent content of 2 percent by weight or less, and preferably 1 percent by weight or less.

As used herein the term "ash-free coal (finally-obtained ash-free coal)" refers to one having an ash content of 5 percent by weight or less, and preferably 3 percent by weight or less. The ash-free coal has a moisture content of 1.0% or less, and generally 0.5% or less. Thus, the ash-free coal contains little ash and substantially no moisture. The ash-free coal typically has a heating value (heat output) higher than that of the material coal. In addition, the ash-free coal has significantly better thermoplasticity and exhibits furthermore excellent performance (fluidity) than that of the material coal. The thermoplasticity is the property or quality particularly important as a coal for iron-making coke. The ash-free coal is therefore usable in a coal blend for coke making.

The method according to the present embodiment employs two solvent separation substeps (pressure-reducing substep and heating substep) in the ash-free coal obtaining step as described above. The solvent, even when unrecoverable in the pressure-reducing substep, can thereby be recovered in the heating substep. The ash-free coal obtaining step includes the two solvent separation substeps as described above. This is because the pressure-reducing substep, if performed alone, may leave part of the solvent in the ash-free coal, although the solvent is desirably removed as much as possible in the pressure-reducing substep. Thus, the solid ash-free coal is heated in the heating substep to remove the solvent with a higher rate. This results in sufficient solvent recovery and gives a higher solvent recovery rate than that in customary techniques (e.g., PTL 1). The ash-free coal obtaining step may include three or more solvent separation substeps.

Residue Coal Obtaining Step

The residue coal obtaining step is the step of evaporatively separating the solvent from the solids-enriched fluid to give a residue coal and is performed in the solvent separator 12 in FIG. 1, where the solids-enriched fluid has been separated using the gravitational settling tank 8 in the separation step. The method does not have to include the residue coal obtaining step.

The separation of the solvent from the solids-enriched fluid may be performed by regular distillation technique or evaporation technique, such as the flash vaporization. The separated and recovered solvent can be recycled to and reused in the slurry preparation tank 4. After separation and recovery of the solvent, the solids-enriched fluid yields a residue coal (RC; also called "residual coal") containing ash and other solvent-insoluble components as concentrated. The residue coal contains substantially no moisture and has a sufficient heating value (heat output), although containing ash. The residue coal does not exhibit thermoplasticity, but, when used in a coal blend, does not adversely affect thermoplasticity of other coals, because oxygen-containing functional groups have been eliminated therefrom. The residue coal may therefore be usable as part of a coal blend for coke making in the same way as common non- or slightly-caking coal. The residue coal may also be used as a fuel for various applications instead of being used as the coal for coke making. The residue coal may be discarded without recovery.

In an embodiment, the residue coal obtaining step includes divided substeps, i.e., a first solvent separation substep of evaporatively separating the solvent from the solids-enriched fluid; and a second solvent separation substep of evaporatively separating a residual solvent from the residue coal obtained from the first solvent separation substep. Specifically, the residue coal obtaining step may have two solvent separation substeps. Thus, the solvent, even if unrecoverable in the first solvent separation substep, can be recovered in the second solvent separation substep. The method according to the embodiment can therefore have a higher solvent recovery rate also in the residue coal obtaining step. In another embodiment, the residue coal obtaining step may include three or more solvent separation substeps.

When the residue coal obtaining step includes two solvent separation substeps, the first solvent separation substep preferably gives a solid residue coal and more preferably gives a solid residual coal having a residual solvent content of 10 percent by weight or less. This prevents the residue coal from fusing or precipitating onto the heat source (e.g., the tube of the steam tube dryer) in the second solvent separation substep and from causing inferior heat exchange efficiency and a lower solvent recovery rate.

In a preferred embodiment, the first and second solvent separation substeps employ the flash vaporization and the distillation with a steam tube dryer, respectively, as in the ash-free coal obtaining step.

EXAMPLES

Example 1

Ash-free coals containing a residual solvent in contents of 5 percent by weight, 10 percent by weight, and 15 percent by weight, respectively, were prepared as ash-free coals in the midway of solvent recovery in the ash-free coal obtaining step (ash-free coals obtained from the pressure-reducing substep). The ash-free coals were each solid. Each of the prepared ash-free coals was heated to a temperature of around 215° C. and subjected to a drying test, where the temperature corresponds to a condition of a steam pressure of 2.05 MPa in a steam tube dryer. Each ash-free coal was charged into a round-bottomed flask that was then placed in a mantle heater and heated. The inside of the round-bottomed flask was in a nitrogen atmosphere.

The ash-free coals containing the residual solvent in contents of 5 percent by weight and 10 percent by weigh, respectively, did not fuse even when heated to 220° C. and, even after the test, could be recovered in the same form as before the test. In contrast, it was found that the ash-free coal containing the residual solvent in a content of 15 percent by weight slightly fused at an elevated temperature of around 180° C. The experiment revealed that the content of residual solvent in the ash-free coal is preferably adapted to be 10 percent by weight or less so as to prevent fusion of the ash-free coal.

Example 2

Next, a drying test was performed with a steam tube dryer. The ash-free coal containing the residual solvent in a content of 15 percent by weight was used as an ash-free coal in the midway of solvent recovery in the ash-free coal obtaining step (i.e., an ash-free coal obtained from the pressure-reducing substep). The ash-free coal was solid. This was subjected to the drying test at a steam pressure of 2.05 MPa (215° C.). As a result, the ash-free coal fused to the periphery of the tube to some extent. The experiment demonstrates that the ash-free coal containing the residual solvent in a content of 15 percent by weight, when applied to a steam tube dryer, fused to some extent in the actual equipment, although evaporative separation could be performed.

Example 3

Figure 3:
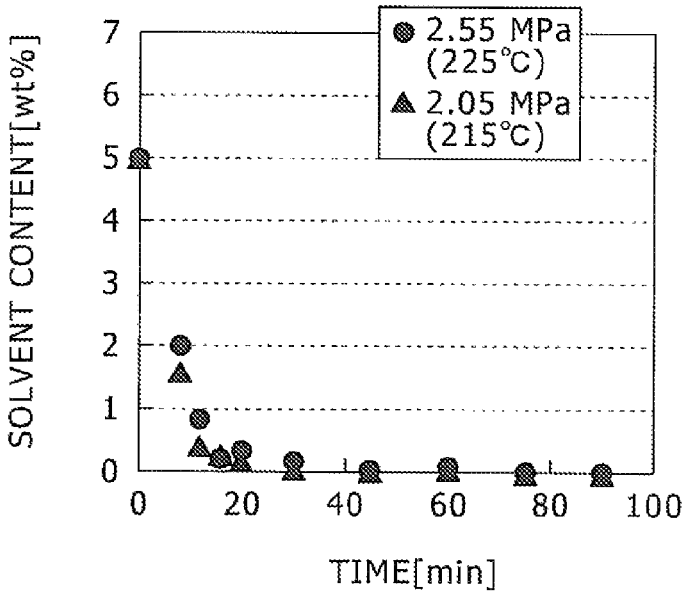
FIG. 3 is a graph illustrating measurement results of residual solvent content.

A drying test was performed with a steam tube dryer. The test employed the ash-free coal containing the residual solvent in a content of 5 percent by weight as an ash-free coal in the midway of solvent recovery in the ash-free coal obtaining step (i.e., an ash-free coal obtained from the pressure-reducing substep). The test was performed under two different conditions, i.e., at steam pressures of 2.05 MPa (215° C.) and 2.55 MPa (225° C.), respectively. The ash-free coal used herein was solid. The results are indicated in FIG. 3. FIG. 3 demonstrates that the residual solvent content ("solvent content" in FIG. 3) significantly reduced during a period from the drying start to a lapse of 12 minutes and reached 1 percent by weight or less after a lapse of 12 minutes under each condition. Thirty (30) minutes into drying, the residual solvent content further reduced to about 0.1 percent by weight and approximately leveled off thereafter. The experiment demonstrates that approximately 100 percent by weight of the solvent could be recovered in a short time of about 30 minutes under either temperature condition when employing the ash-free coal containing the residual solvent in a content of 5 percent by weight.

Advantageous Effects of Ash-Free Coal Production Method According to First Embodiment Next, advantageous effects of the ash-free coal production method according to the first embodiment will be illustrated.

The ash-free coal production method employs an ash-free coal obtaining step including two substeps, i.e., a pressure-reducing substep of reducing a pressure to a level lower than the solvent vapor pressure to evaporatively separate the solvent from the solution to give a solid ash-free coal; and a heating substep of heating the solid ash-free coal obtained from the pressure-reducing substep to evaporatively separate a residual solvent from the ash-free coal.

A solvent, even if unrecoverable in the pressure-reducing substep, can be recovered in the heating substep. This allows the solvent to be recovered sufficiently and allows the method to exhibit a higher solvent recovery rate than that of the customary techniques (e.g., PTL 1).

The method does not have to heat the solvent upon evaporative separation in the pressure-reducing substep and less causes the fusing or precipitation of the ash-free coal than a method employing distillation with a heat source (e.g., distillation with a steam tube dryer) in the pressure-reducing substep does.

The method does not require an operation of re-liquefying an ash-free coal obtained from the pressure-reducing substep, because the ash-free coal to be subjected to the heating substep is solid, from which the solvent has been evaporatively separated to a certain extent in the pressure-reducing substep. This can minimize the fusing or precipitation of the ash-free coal onto the heat source and results in better heat exchange efficiency and a higher solvent recovery rate. In addition, the method allows evaporative separation of the solvent to be performed in a short time, because heating is employed to evaporatively separate the solvent.

Thus, the method can efficiently produce the ash-free coal.

The ash-free coal production method produces the ash-free coal with satisfactory production efficiency because it employs distillation by pressure reduction (e.g., flash vaporization or vacuum distillation) in the pressure-reducing substep and distillation by heating (e.g., distillation with a steam tube dryer) in the heating substep. Specifically, distillation by heating, if employed in the pressure-reducing substep, disadvantageously causes the ash-free coal to fuse or precipitate in a large amount onto the heat source. The method, however, is free from the disadvantage because of employing distillation by pressure reduction in the pressure-reducing substep. In contrast, distillation by pressure reduction, if employed in the heating substep, requires re-liquefaction of the ash-free coal obtained from the pressure-reducing substep and requires a long evaporation time. The method, however, does not require re-liquefaction of the ash-free coal and can perform evaporation in a short time because of employing distillation by heating in the heating substep.

In a preferred embodiment, the pressure-reducing substep is performed under a pressure equal to or lower than atmospheric pressure. The ash-free coal production method according to the embodiment can reduce the content of residual solvent in the ash-free coal obtained from the pressure-reducing substep. This protects the ash-free coal from having a lower softening temperature due to remaining of the solvent in the ash-free coal. The resulting ash-free coal can therefore have low plastic property at a heating temperature in the heating substep (e.g., from about 200° C. to about 230° C.) and less fuses or precipitates onto the heat source in the heating substep.

In another preferred embodiment, a content of residual solvent in the ash-free coal obtained from the pressure-reducing substep is adapted to be 10 percent by weight or less. The ash-free coal production method can give an ash-free coal that exhibits little plastic property at a heating temperature in the heating substep (e.g., from about 200° C. to about 230° C.). The method therefore less causes the ash-free coal to fuse or precipitate onto the heat source.

The ash-free coal production method, in an embodiment, employs distillation with a steam tube dryer to evaporatively separate the solvent in the heating substep. The method can charge the solid ash-free coal as in solid form into the dryer and can perform evaporative separation of the solvent in a shorter time, where the solid ash-free coal is obtained from the pressure-reducing substep.

The ash-free coal production method, in an embodiment, employs flash vaporization to evaporatively separate the solvent in the pressure-reducing substep. The method can charge the liquid solution as in liquid form into the flasher where the solid solution is separated in the separation step. The method can therefore produce the ash-free coal with better production efficiency. In an embodiment, the solution is sprayed (flashed) into the flasher (e.g., to the flasher inner wall). This enables efficient evaporative separation of the solvent because the solution is spread with a wider surface area. In addition, this suppresses fusing or precipitation of the ash-free coal in the flasher 10 because the method does not have to heat the inside of the flasher 10.

Second Embodiment

Next, an ash-free coal production method according to the second embodiment will be illustrated with reference to FIG. 4. However, components having similar configurations to those in the first embodiment are indicated with the same reference signs, whose explanation will be omitted as appropriate. Ash-free coal production equipment for use in the present embodiment includes a thin-film distillator 31 instead of the steam tube dryer 11 in the first embodiment. The ash-free coal production method according to the present embodiment employs another ash-free coal obtaining step than that in the first embodiment, but the other steps are the same as in the first embodiment.

Ash-Free Coal Obtaining Step

The ash-free coal obtaining step is the step of separating and recovering a solvent from a solution (supernatant liquid) to give an ash-free coal, where the solution is separated and obtained from the separation step. The ash-free coal obtaining step in the present embodiment includes two divided substeps, i.e., a first evaporation substep of evaporatively separating the solvent from the solution to give an ash-free coal; and a second evaporation substep of further evaporatively separating a residual solvent from the ash-free coal, where the ash-free coal is obtained from the first evaporation substep by evaporative separation of the solvent.

First Evaporation Substep

The first evaporation substep is the step of evaporatively separating the solvent from the solution by flash vaporization, where the solution is separated and obtained from the separation step. The substep is performed in a flasher 10 in FIG. 4. The flash vaporization is an evaporative separation technique of spraying (flashing) a distillation object into the flasher so as to evaporatively separate a substance having a low boiling point from the object. In the present embodiment, the distillation object is the solution separated in the separation step, and the substance having a low boiling point is the solvent. The object may be sprayed typically to the inner wall of the flasher.

The inside pressure of the flasher 10 is preferably adapted to a level lower than the solvent vapor pressure in the present embodiment. The solvent contained in the solution fed into the flasher 10 is thus evaporatively separated from the solution. The separated solvent is recovered, and recycled to and reused in the slurry preparation tank 4. The first evaporation substep is preferably performed in the presence of an inert gas such as nitrogen gas from the viewpoint of solvent recovery.

The solution prior to feeding into the flasher 10 herein is pressurized to a pressure higher than the solvent vapor pressure and is in liquid form. The solution prior to feeding into the flasher 10 may be adapted to have a temperature of typically 300° C.

Flash vaporization, when performed according to a common procedure, generally gives a powdery (solid) ash-free coal. This is typically because the flasher inside pressure is generally adapted to be a level approximately equal to atmospheric pressure, and the solvent evaporates and deprives sensible heat from the ash-free coal. According to the present embodiment, however, the first evaporation substep gives a liquid ash-free coal by allowing the solvent to remain in the ash-free coal in a predetermined content. The inside pressure of the flasher 10 may be set typically to 0.5 MPa so as to easily keep the ash-free coal in liquid form. The inside temperature of the flasher 10 may be adapted to be typically from 200° C. to 450° C. by heating the flasher 10.

The content of residual solvent in the ash-free coal is not critical, as long as the ash-free coal be in liquid form, but is preferably from 10 to 50 percent by weight and more preferably from 15 to 30 percent by weight. The range is preferred so as to easily keep the ash-free coal in liquid form. As used herein the term "content of residual solvent in the ash-free coal" refers to the content (percentage) of the residual solvent in the ash-free coal based on the total amount of the mixture of the ash-free coal and the residual solvent therein. The content of residual solvent in the ash-free coal is from 0 to 2 percent by weight when the solvent is separated in one step as in the customary techniques (e.g., PTL 1).

Exemplary processes to allow the solvent to remain in the ash-free coal include a process of evaporatively separating the solvent from the solution at a temperature lower than the temperature necessary for removing approximately 100 percent by weight (99 percent by weight or more) of the solvent from the solution; a process of evaporatively separating the solvent from the solution for a time (duration) shorter than the time necessary for removing approximately 100 percent by weight (99 percent by weight or more) of the solvent from the solution; and a process as a combination of the two processes. Of the processes, preferred in the first evaporation substep is the process of evaporatively separating the solvent at a temperature lower than the temperature necessary for removing approximately 100 percent by weight of the solvent from the solution. The process is preferred because of less affecting the properties of the resulting ash-free coal.

The ash-free coal, when allowed to contain the residual solvent as above, has a lower initial softening temperature. In addition, there occurs such a phenomenon that the ash-free coal is dissolved in the solvent. The ash-free coal can exhibit fluidity at a lower temperature. This allows the ash-free coal to keep its liquid form at a temperature lower than that of an ash-free coal containing little solvent. The ash-free coal can therefore be transferred with satisfactory handleability and can be easily transferred from the first evaporation substep to the second evaporation substep.

In a preferred embodiment, the ash-free coal obtained from the first evaporation substep is transferred with heating to the second evaporation substep so as to allow the ash-free coal to easily keep its liquid form and to be in a high-fluidity state. The temperature of the ash-free coal during transfer is typically 300° C.

The present embodiment employs flash vaporization in the first evaporation substep, but can employ any other technique such as thin-film distillation or vacuum distillation. The thin-film distillation will be described in detail later.

Second Evaporation Substep

Figure 4:
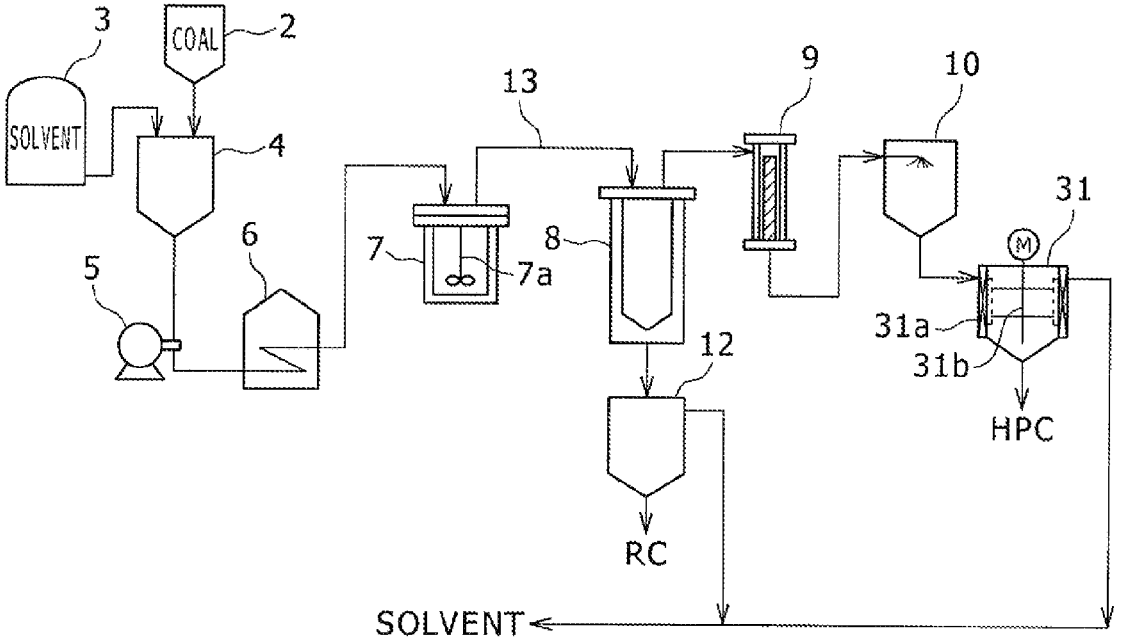
FIG. 4 is a schematic diagram illustrating ash-free coal production equipment for use in a second embodiment of the present invention.

The second evaporation substep is the step of evaporatively separating the solvent from an ash-free coal and is performed in the thin-film distillator 31 in FIG. 4, where the ash-free coal is obtained from the first evaporation substep by thin-film distillation. The ash-free coal obtained from the first evaporation substep contains the residual solvent in a predetermined content. The "thin-film distillation" refers to a distillation technique in which a distillation object is fed into the thin-film distillator 31 from its upper part, where the thin-film distillator 31 houses a scraper 31*b* (also called "wiper"); and a thin film of the distillation object is formed on the inner wall of the thin-film distillator 31 with the scraper 31*b* to perform distillation continuously. The distillation object in the present embodiment is the ash-free coal obtained from the first evaporation substep. A heater 31*a* is arranged around the thin-film distillator 31 and externally heats the thin-film distillator 31 so as to allow the inner wall of the thin-film distillator 31 to have a desired temperature.

The liquid ash-free coal obtained from the first evaporation substep is fed in liquid form into the thin-film distillator 31 and heated externally by the heater 31*a*. Thus, the residual solvent in the ash-free coal is evaporatively separated (removed) therefrom. This gives an ash-free coal from which approximately 100 percent by weight of the solvent has been removed. The separated solvent is recovered, and recycled to and reused in the slurry preparation tank 4. The second evaporation substep is preferably performed in the presence of an inert gas such as nitrogen gas from the viewpoint of solvent recovery.

The inside pressure of the thin-film distillator 31 may be 0.1 MPa (normal atmospheric pressure) or less than 0.1 MPa (normal atmospheric pressure). The heating temperature (inside temperature of the thin-film distillator 31) may be typically from 250° C. to 350° C. The thin-film distillation gives a liquid ash-free coal, when allowing the inside temperature of the thin-film distillator 31 to fall within the range. The resulting liquid ash-free coal can be easily solidified into an ash-free coal having a desired shape by bringing the liquid ash-free coal into contact with (e.g., dropping the same onto) a solidifier at a temperature of from about 0° C. to 150° C. The solidifier is exemplified by water, a metallic endless belt constituting a conveyor belt, and a forming die having a cavity with a predetermined shape. The method employing the thin-film distillation can therefore eliminate the need of the steps of re-liquefying the ash-free coal and solidifying the liquefied ash-free coal into a desired shape.

The present embodiment employs thin-film distillation in the second evaporation substep, but may employ any other technique such as flash vaporization or vacuum distillation. Specifically, the method may employ flash vaporization both in the first evaporation substep and in the second evaporation substep; or may employ thin-film distillation both in the first evaporation substep and in the second evaporation substep.

The first and second evaporation substeps can give an ash-free coal from the solution, where the ash-free coal contains substantially no ash, and approximately 100 percent by weight of the solvent has been removed therefrom.

The ash-free coal obtaining step in the method includes two solvent separation substeps as described above, and a solvent, even if unrecoverable in the first evaporation substep, can be recovered in the second evaporation substep. This contributes to sufficient recovery of the solvent with a higher solvent recovery rate. The ash-free coal obtaining step may include three or more solvent separation substeps.

Advantageous Effects of Ash-free Coal Production Method According to Second Embodiment Next, advantageous effects of the ash-free coal production method according to the second embodiment will be described.

The ash-free coal obtaining step in the ash-free coal production method according to the present embodiment includes the first evaporation substep of evaporatively separating the solvent from the solution; and the second evaporation substep of further evaporatively separating a residual solvent from the ash-free coal, where the ash-free coal is obtained from the first evaporation substep by evaporative separation of the solvent. In the method, the first evaporation substep is performed so as to allow the solvent to remain in the ash-free coal in a predetermined content to thereby allow the ash-free coal to be in liquid form, and the liquid ash-free coal is transferred in liquid form to the second evaporation substep. The solvent, even if unrecoverable in the first evaporation substep, can be recovered in the second evaporation substep. This contributes to sufficient recovery of the solvent and to a higher solvent recovery rate. In addition, the ash-free coal obtained from the first solvent separation substep can exhibit fluidity at a lower temperature because the first evaporation substep is performed so as to allow the ash-free coal to contain the residual solvent in a predetermined content and to thereby have a lower softening temperature. This enables the ash-free coal to remain in liquid form at a lower temperature. The resulting ash-free coal has satisfactory handleability (handleability as a liquid) upon transfer and can be easily transferred from the first evaporation substep to the second evaporation substep.

The method according to the present embodiment does not have to separate or remove approximately 100% of the solvent in the first evaporation substep as in the customary techniques (e.g., PTL 1). This is because the ash-free coal obtaining step includes divided substeps, i.e., the first evaporation substep and the second evaporation substep. The solvent, even though allowed to remain in the ash-free coal in the first evaporation substep, can be recovered from the ash-free coal in the second evaporation substep. Accordingly, the first evaporation substep can be performed so as to allow the solvent to remain in the ash-free coal.

In a preferred embodiment of the ash-free coal production method, the solvent remains in the ash-free coal obtained from the first evaporation substep in a content of from 10 percent by weight to 50 percent by weight. The ash-free coal, when containing the residual solvent in a content of 10 percent by weight or more, can have better plastic property, can easily keep its liquid form, and exhibits better fluidity in liquid form. In contrast, the ash-free coal, when containing the residual solvent in a content of 50 percent by weight or less, can be subjected to evaporative separation of the solvent under a smaller load in the second evaporation substep, from which approximately 100% of the solvent can be readily separated and recovered.

The ash-free coal production method, when employing flash vaporization to evaporatively separate the solvent in the first evaporation substep, can charge the liquid solution as in liquid form into the flasher, where the liquid solution is separated and obtained from the separation step. This contributes to better production efficiency of the ash-free coal and to facilities cost saving. In an embodiment, the solution is sprayed (flashed) into the flasher (e.g., to the flasher inner wall). This enables efficient evaporative separation of the solvent because the solution is spread with a wider surface area.

The ash-free coal production method, when employing thin-film distillation to evaporatively separate the solvent in the second evaporation substep, can feed the liquid ash-free coal as intact as in liquid form into the thin-film distillator. This contributes to better production efficiency of the ash-free coal and to facilities cost saving. In addition, the ash-free coal is obtained in liquid form from the second evaporation substep, from which approximately 100% of the solvent has been removed. The resulting liquid ash-free coal, when brought into contact with a solidifier, can be easily solidified into an ash-free coal having a desired shape. The method can therefore eliminate the steps of re-liquefying the powdery (solid) ash-free coal and solidifying the liquefied ash-free coal into a desired shape. The method, when employing a scraper (wiper), can reliably scrape off a thin-film layer formed on the inner wall of the thin-film distillator and can reliably discharge even when the ash-free coal, for example, has poor fluidity (high viscosity).

While the present invention has been described above with reference to preferred embodiments thereof, it is to be understood that the embodiments are never intended to limit the scope of the invention; and that various modifications and changes can be made therein without departing from the spirit and scope of the appended claims.

REFERENCE SIGNS LIST

1 ash-free coal production equipment
2 coal hopper
3 solvent tank
4 slurry preparation tank
5 pump
6 preheater
7 extractor
8 gravitational settling tank
9 filter unit
10 flasher
11 steam tube dryer
12 solvent separator
13 pipe
31 thin-film distillator

The invention claimed is:

1. A method for producing an ash-free coal, the method comprising the steps of:

extracting a solvent-soluble coal component from coal by mixing the coal with a solvent to give a slurry and heating the slurry;

separating a solution containing the coal component from the slurry, the slurry containing the extracted coal component extracted in the extraction step; and obtaining an ash-free coal by separating and recovering the solvent from the solution separated in the separation step, wherein:

the ash-free coal obtaining step comprises the substeps of:

pressurizing the solution to a pressure higher than a vapor pressure of the solvent;

introducing the solution into a flasher, the flasher having a pressure at a level lower than the vapor pressure of the solvent;

flash vaporizing the solution within the flasher to evaporatively separate the solvent from the solution to thereby give a solid ash-free coal having a content of residual solvent of 10 percent by weight or less; and heating the solid ash-free coal obtained from the pressure-reducing substep to evaporatively separate a residual solvent from the ash-free coal.

2. The ash-free coal production method according to claim 1, wherein the pressure-reducing substep is performed to reduce the pressure to a level equal to or lower than atmospheric pressure.

3. A method for producing an ash-free coal, the method comprising the steps of:

extracting a solvent-soluble coal component from coal by mixing the coal with a solvent to give a slurry and heating the slurry;

separating a solution containing the coal component from the slurry, the slurry containing the extracted coal component extracted in the extraction step; and obtaining an ash-free coal by separating and recovering the solvent from the solution separated in the separation step, wherein:

the ash-free coal obtaining step comprises:

a first evaporation substep of evaporatively separating the solvent from the solution to give an ash-free coal; and a second evaporation substep of evaporatively separating a residual solvent from the ash-free coal, the ash-free coal obtained from the first evaporation substep by evaporative separation of the solvent;

the first evaporation substep is performed so as to allow the solvent to remain in the ash-free coal and to allow the ash-free coal to be in liquid form; and the liquid ash-free coal is transferred in liquid form to the second evaporation substep.

4. The ash-free coal production method according to claim 3, wherein a content of residual solvent in the ash-free coal obtained from the first evaporation substep is from 10 percent by weight to 50 percent by weight.

* * * * *